US011193254B2

(12) United States Patent
Moriki et al.

(10) Patent No.: US 11,193,254 B2
(45) Date of Patent: Dec. 7, 2021

(54) CONSTRUCTION MACHINE

(71) Applicant: Hitachi Construction Machinery Co., Ltd., Tokyo (JP)

(72) Inventors: Hidekazu Moriki, Tokyo (JP); Akira Kanazawa, Tokyo (JP); Takaaki Chiba, Tokyo (JP); Shinya Imura, Tsuchiura (JP); Yasutaka Tsuruga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/255,934

(22) PCT Filed: Sep. 3, 2019

(86) PCT No.: PCT/JP2019/034581
§ 371 (c)(1),
(2) Date: Dec. 23, 2020

(87) PCT Pub. No.: WO2020/054507
PCT Pub. Date: Mar. 19, 2020

(65) Prior Publication Data

US 2021/0262200 A1 Aug. 26, 2021

(30) Foreign Application Priority Data

Sep. 11, 2018 (JP) ..... JP2018-169392

(51) Int. Cl.
*E02F 9/22* (2006.01)
*E02F 3/43* (2006.01)
(Continued)

(52) U.S. Cl.
CPC ..... *E02F 9/2228* (2013.01); *E02F 3/435* (2013.01); *E02F 9/2267* (2013.01);
(Continued)

(58) Field of Classification Search
CPC ..... F15B 11/042; F15B 11/046; F15B 11/16; F15B 2211/455; F15B 2211/46; F15B 2211/30575
See application file for complete search history.

(56) References Cited

U.S. PATENT DOCUMENTS 6,467,264 B1 * 10/2002 Stephenson ..... F15B 11/006 60/368
6,502,393 B1 * 1/2003 Stephenson ..... F15B 11/006 60/414

(Continued)

FOREIGN PATENT DOCUMENTS

JP 6-117408 A 4/1994

OTHER PUBLICATIONS

International Preliminary Report on Patentability (PCT/IB/338 & PCT/IB/373) issued in PCT Application No. PCT/JP/2019/034581 dated Mar. 25, 2021, including English translation of document C2 (Japanese-language Written Opinion (PCT/ISA/237) filed on Dec. 23, 2020) (10 pages).

(Continued)

*Primary Examiner* — Thomas E Lazo
(74) *Attorney, Agent, or Firm* — Crowell & Moring LLP

(57) ABSTRACT

To provide a construction machine that can highly precisely control branch flows from a hydraulic pump to a plurality of hydraulic actuators without being affected by load conditions. A controller (100) has a meter-out valve control section (140) configured to calculate a target opening area of a second meter-out valve (65*a*) (65*b*) according to a pressure difference between a supply pressure and a second meter-in pressure, or calculate a target opening area of a first meter-out valve (55*a*) (55*b*) according to a pressure difference between the supply pressure and the first meter-in pressure.

5 Claims, 11 Drawing Sheets

(51) Int. Cl.

| | |
|---|---|
| ***F15B 11/028*** | (2006.01) |
| ***F15B 11/042*** | (2006.01) |
| ***F15B 11/044*** | (2006.01) |
| ***F15B 11/05*** | (2006.01) |
| ***F15B 11/16*** | (2006.01) |

(52) U.S. Cl.
CPC ..... *F15B 11/028* (2013.01); *F15B 11/042* (2013.01); *F15B 11/044* (2013.01); *F15B 11/05* (2013.01); *F15B 11/16* (2013.01)

(56) References Cited

U.S. PATENT DOCUMENTS

| | | | | |
|---|---|---|---|---|
| 7,997,117 | B2 * | 8/2011 | Zhang | F16K 37/0083 73/1.79 |
| 9,809,957 | B2 * | 11/2017 | Rosth | F15B 1/033 |
| 2002/0162327 | A1 * | 11/2002 | Stephenson | F15B 11/006 60/422 |
| 2010/0043418 | A1 * | 2/2010 | Verkuilen | F15B 11/163 60/327 |
| 2015/0082782 | A1 * | 3/2015 | Choi | F15B 11/006 60/327 |

OTHER PUBLICATIONS

International Search Report (PCT/ISA/210) issued in PCT Application No. PCT/JP2019/034581 dated Nov. 26, 2019 with English translation (two (2) pages).
Japanese-language Written Opinion (PCT/ISA/237) issued in PCT Application No. PCT/JP2019/034581 dated Nov. 26, 2019 (six (6) pages).

* cited by examiner

CONSTRUCTION MACHINE

TECHNICAL FIELD

The present invention relates to a construction machine such as a hydraulic excavator.

BACKGROUND ART

In a construction machine (e.g. a hydraulic excavator), a hydraulic fluid delivered from a hydraulic pump is caused to flow into one of oil chambers of a hydraulic actuator (meter-in), the hydraulic fluid is caused to be discharged from the other oil chamber of the hydraulic actuator to a tank (meter-out), and thereby the hydraulic actuator is operated. The flow rate of the hydraulic fluid to flow into the one of the oil chambers of the hydraulic actuator (meter-in flow rate) is adjusted by a meter-in valve, for example, and the flow rate of the hydraulic fluid to be discharged from the other oil chamber of the hydraulic actuator to the tank (meter-out flow rate) is adjusted by a meter-out valve, for example. The valve bodies of these valves are moved according to lever operation by an operator or target velocities of the hydraulic actuator calculated at a controller. Typically, the rates of flows passing through the valves are determined by the opening areas of the valves (the movement amounts of the valve bodies), and the differential pressures across the valves. Among them, the differential pressures across the valves vary depending on the magnitude of a load acting on the hydraulic actuator. Accordingly, the opening areas of the valves are adjusted by the operator by means of lever operation and by the controller by means of a control signal for the meter-in valve, and the flow rate of the hydraulic fluid to be supplied to and discharged from the hydraulic actuator, that is, the operation velocity of the hydraulic actuator, is controlled.

In addition, in a case where the hydraulic fluid is supplied from the one hydraulic pump to a plurality of hydraulic actuators also, the meter-in flow rate of each hydraulic actuator is determined by the opening area of each meter-in valve and the differential pressure across the meter-in valve. In a case where the magnitudes of loads acting on the plurality of hydraulic actuators are different from each other, the hydraulic fluid is easily flown to a hydraulic actuator receiving a lower load, and thus the simultaneous supplying of the hydraulic fluid (generating branch flows of the hydraulic fluid) to the plurality of hydraulic actuators requires adjustment of the opening areas of the meter-in valves according to the differential pressures across the meter-in valves.

For example, the technique of Patent Document 1 is configure such that there are provided a stroke sensor (valve position sensor) that senses the stroke of a control valve and pressure sensors that sense the pressures before and after the control valve, and on the basis of signals from these sensors and a signal from a main controller, a valve controller electrically controls the opening of the control valve.

PRIOR ART DOCUMENT

Patent Document

Patent Document 1: JP-1994-117408-A

SUMMARY OF THE INVENTION

Problems to be Solved by the Invention

However, there is a fear about a hydraulic circuit of a construction machine described in Patent Document 1 that the operation velocity of each hydraulic actuator cannot be controlled accurately depending on load conditions of a plurality of hydraulic actuators. This is because hydrodynamic forces that act on control valves, errors of valve position sensors and errors of pressure sensors are not taken into consideration.

For example, in a case where loads that act on respective of the plurality of hydraulic actuators significantly differ, a differential pressure across a meter-in valve corresponding to a hydraulic actuator receiving a lower load (a pressure difference between the delivery pressure of a hydraulic pump and the load pressure on the hydraulic actuator) increases. Typically, as the differential pressure across a meter-in valve increases, the opening area required for obtaining a desired meter-in flow rate decreases, and the flow rate (the flow rate per unit opening area) increases by a corresponding amount. As a result, a hydrodynamic force that acts on the valve body increases, and errors of the opening area of the meter-in valve easily occur. In addition, since a change amount of the meter-in flow rate in relation to a change amount of the opening area of the meter-in valve increases, flow rate errors increase in relation to the errors of the opening area of the meter-in valve. That is, as the differential pressure across the meter-in valve increases, flow rate errors caused by a hydrodynamic force, and by errors of the valve position sensor increase.

On the other hand, in a case where loads that act on the plurality of hydraulic actuators are very close to each other, the meter-in pressures of the hydraulic actuators become almost equal to supply pressures. Accordingly, errors of the pressure sensors relatively increase in relation to the differential pressures across the meter-in valves, and it becomes difficult to compute desired target opening areas from measurement values of the differential pressures across the meter-in valves. That is, as the differential pressures across the meter-in valves decrease, flow rate errors caused by errors of the pressure sensors increase.

The present invention has been made in view of the problems described above, and an object of the present invention is to provide a construction machine that can control branch flows from a hydraulic pump to a plurality of hydraulic actuators highly precisely without being affected by load conditions.

Means for Solving the Problems

In order to achieve the object described above, the present invention provides a construction machine including: a tank; a hydraulic pump; a first hydraulic actuator and a second hydraulic actuator each having two supply and discharge ports; a first meter-in valve provided on a hydraulic line connecting one of the supply and discharge ports of the first hydraulic actuator to the hydraulic pump; a second meter-in valve provided on a hydraulic line that establishes communication between one of the supply and discharge ports of the second hydraulic actuator and the hydraulic pump; a first meter-out valve provided on a hydraulic line that establishes communication between the other one of the supply and discharge ports of the first hydraulic actuator and the tank; a second meter-out valve provided on a hydraulic line that establishes communication between the other one of the supply and discharge ports of the second hydraulic actuator and the tank; a first pressure sensor that senses a first meter-in pressure that is a pressure on the one of the supply and discharge ports of the first hydraulic actuator; a second pressure sensor that senses a second meter-in pressure that is a pressure on the one of the supply and discharge ports of the second hydraulic actuator; a third pressure sensor that senses a supply pressure that is a delivery pressure of the hydraulic pump; and a controller having a meter-in valve control section configured to calculate a target opening area of the first meter-in valve according to a pressure difference between the supply pressure and the first meter-in pressure, and calculate a target opening area of the second meter-in valve according to a pressure difference between the supply pressure and the second meter-in pressure. The controller has a meter-out valve control section configured to calculate a target opening area of the second meter-out valve according to the pressure difference between the supply pressure and the second meter-in pressure, or calculate a target opening area of the first meter-out valve according to the pressure difference between the supply pressure and the first meter-in pressure.

According to the thus-configured present invention, by controlling the second meter-out valve according to the pressure difference between the supply pressure and the second meter-in pressure or by controlling the first meter-out valve according to the pressure difference between the supply pressure and the first meter-in pressure, the differential pressure across the first meter-in valve or the second meter-in valve that supplies the hydraulic fluid to one of that first hydraulic actuator and the second hydraulic actuator that is receiving a lower load lowers. Thereby, without being affected by load conditions of the first and second actuators, the opening areas of the first meter-in valve and the second meter-in valve increase, and change amounts of the meter-in flow rates in relation to change amounts of the opening areas decrease. Accordingly, meter-in flow-rate errors caused by a hydrodynamic force that acts on the valve body of the first meter-in valve or the second meter-in valve, or by errors of the opening area of the first meter-in valve or the second meter-in valve are reduced.

Advantages of the Invention

According to the present invention, it becomes possible, in a construction machine, to control branch flows from a hydraulic pump to a plurality of hydraulic actuators highly precisely without being affected by load conditions.

MODES FOR CARRYING OUT THE INVENTION

Figure 1:
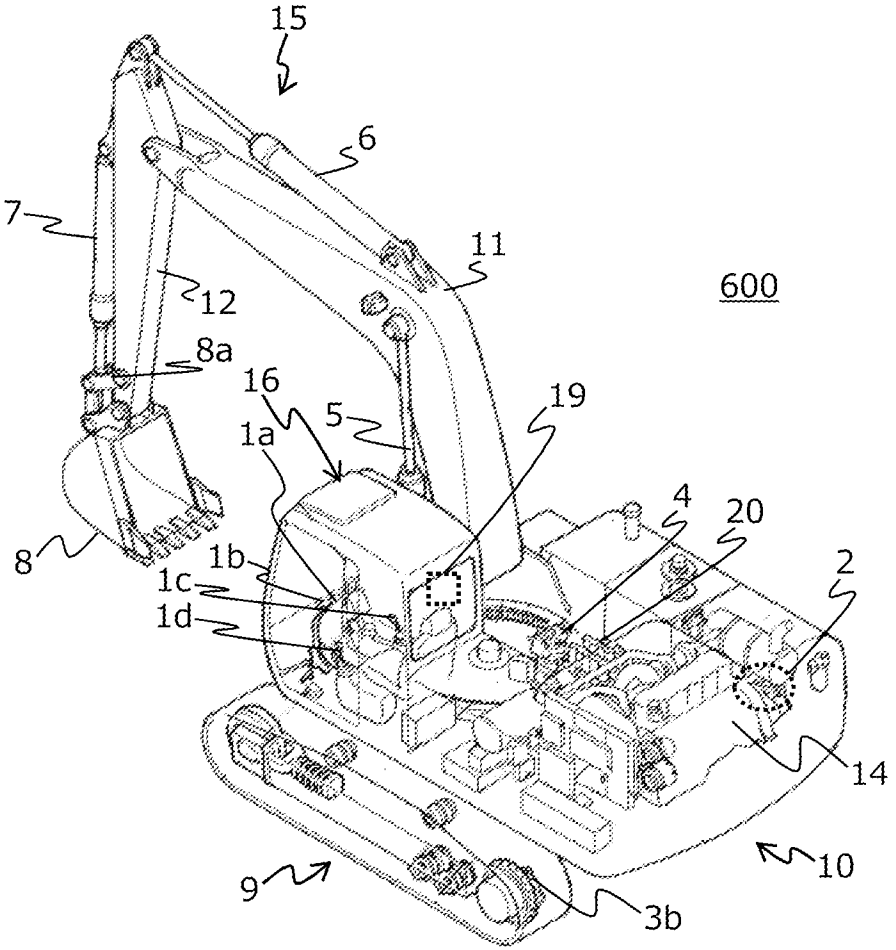
FIG. 1 is a figure schematically illustrating the external appearance of a hydraulic excavator according to a first embodiment of the present invention.

Hereinafter, a hydraulic excavator is explained as an example of a construction machine according to embodiments of the present invention with reference to the drawings. Note that equivalent members are given the same reference characters in the drawings, and overlapping explanations are omitted as appropriate.

First Embodiment

A first embodiment of the present invention is explained with reference to FIG. 1 to FIG. 6.

FIG. 1 is a figure schematically illustrating the external appearance of a hydraulic excavator according to the present embodiment.

In FIG. 1, a hydraulic excavator 600 includes: an articulated front device (front work implement) 15 including a plurality of driven members (a boom 11, an arm 12, a bucket (work instrument) 8) that are coupled to each other so as to be individually vertically pivoted; and an upper swing structure 10 and a lower track structure 9 which configure a machine body. The upper swing structure 10 is swingably provided relative to the lower track structure 9.

The base end of the boom 11 of the front device 15 is vertically pivotably supported at a front section of the upper swing structure 10. One end of the arm 12 is vertically pivotably supported at the tip of the boom 11. The bucket 8 is vertically pivotably supported at the other end of the arm 12 via a bucket link 8*a*.

The boom 11, the arm 12, the bucket 8, the upper swing structure 10 and the lower track structure 9 are driven by a boom cylinder 5, an arm cylinder 6, a bucket cylinder 7, a swing hydraulic motor 4 and left and right travel hydraulic motors 3*b* (only the left travel hydraulic motor is illustrated), respectively, which are hydraulic actuators.

A cab 16 in which an operator gets is provided with: a right operation lever device 1*c* and a left operation lever device 1*d* for outputting operation signals for operating the hydraulic actuators 5 to 7 of the front device 15, and the swing hydraulic motor 4 of the upper swing structure 10; and a travel right operation lever device 1*a* and a travel left operation lever device 1*b* that output operation signals for operating the left and right travel hydraulic motors 3*b* of the lower track structure 9.

The left and right operation lever devices 1*c* and 1*d* are electric operation lever devices that output electric signals as the operation signals. The left and right operation lever devices 1*c* and 1*d* each have an operation lever that is operated to incline forward and backward, and leftward and rightward by the operator, and an electric signal generating section that generates an electric signal according to the inclination direction and inclination amount (lever operation amount) of the operation lever. The electric signals output from the operation lever devices 1*c* and 1*d* are input to a controller 100 (illustrated in FIG. 2) via electric wires. In the present embodiment, forward/backward operation of the operation lever of the right operation lever device 1*c* corresponds to operation of the boom cylinder 5, and leftward/rightward operation of the operation lever corresponds to operation of the bucket cylinder 7. On the other hand, forward/backward operation of the operation lever of the left operation lever device 1*c* corresponds to operation of the swing hydraulic motor 4, and leftward/rightward operation of the operation lever corresponds to operation of the arm cylinder 6.

Operation control of the boom cylinder 5, the arm cylinder 6, the bucket cylinder 7, the swing hydraulic motor 4 and the left and right travel hydraulic motors 3*b* is performed by controlling, with a control valve 20, the direction and flow rate of a hydraulic operating fluid supplied from a hydraulic pump device 2 driven by a prime mover such as an engine or an electric motor (an engine 14 in the present embodiment) to the hydraulic actuators 3*b* and 4 to 7.

Figure 2:
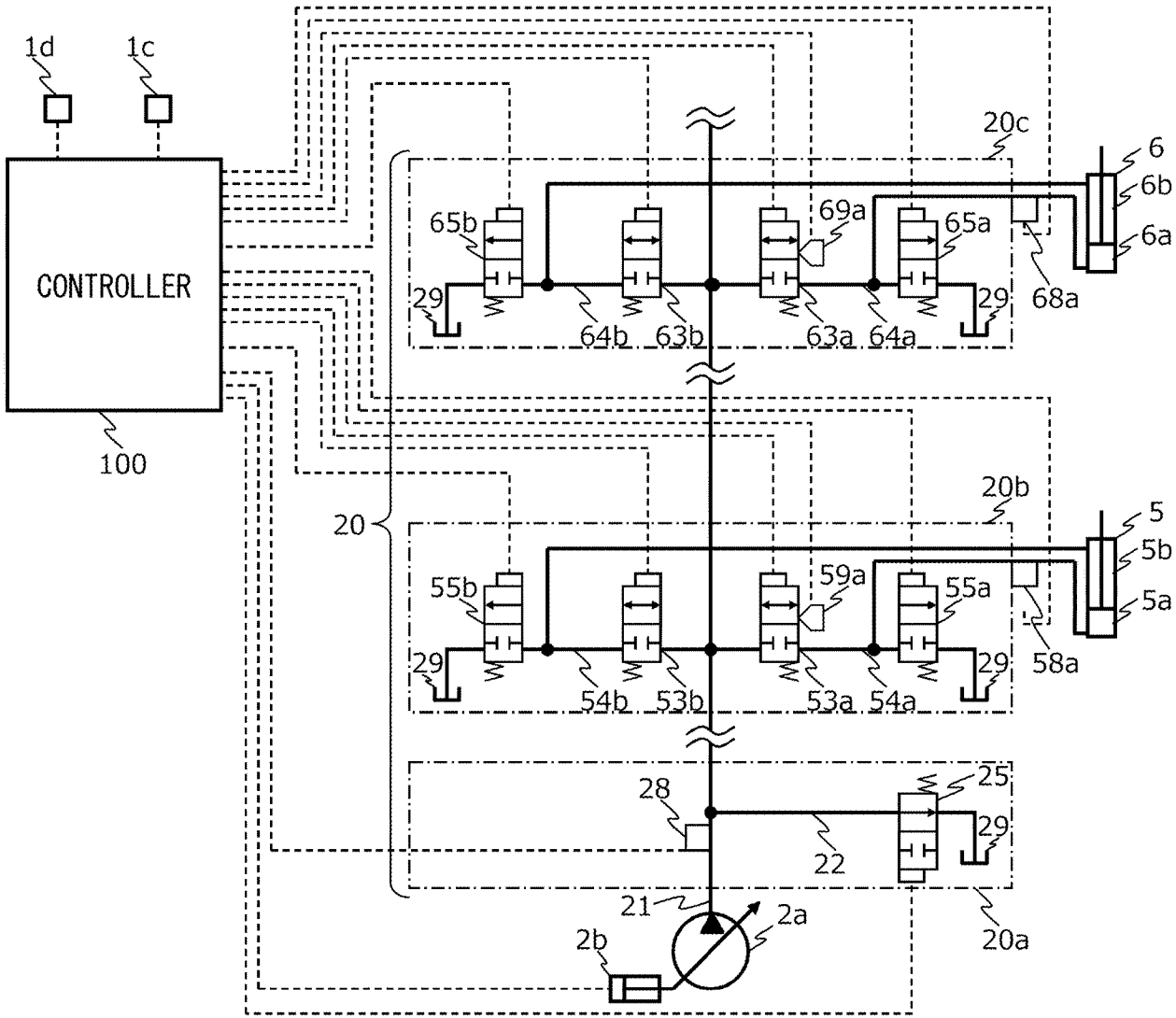
FIG. 2 is a schematic configuration diagram of a hydraulic-actuator control system mounted on the hydraulic excavator illustrated in FIG. 1.

The control valve 20 is driven by a control signal output from the controller 100 (illustrated in FIG. 2). In response to a control signal output from the controller 100 to the control valve 20, which is based on the operation of the travel right operation lever device 1*a* and the travel left operation lever device 1*b*, operation of the left and right travel hydraulic motors 3*b* of the lower track structure 9 is controlled. In addition, in response to a control signal output from the controller 100 to the control valve 20, which is based on the operation signals from the operation lever devices 1*c* and 1*d*, operation of the hydraulic actuators 3*b* and 4 to 7 is controlled. The boom 11 is pivoted in the upward/downward direction relative to the upper swing structure 10 according to the expansion and contraction of the boom cylinder 5. The arm 12 is pivoted in the upward/downward and forward/backward directions relative to the boom 11 according to the expansion and contraction of the arm cylinder 6. The bucket 8 is pivoted in the upward/downward and forward/backward directions relative to the arm 12 according to the expansion and contraction of the bucket cylinder 7.

FIG. 2 is a schematic configuration diagram of a hydraulic-actuator control system mounted on the hydraulic excavator 600.

In FIG. 2, the hydraulic-actuator control system includes the controller 100 that controls operation of the hydraulic excavator 600, and the control valve 20 that drives the boom cylinder 5 and the arm cylinder 6. Note that only a bleed-off section 20*a*, a boom section 20*b*, and an arm section 20*c* of the control valve 20 are illustrated, and other sections are omitted in FIG. 2 for simplification of explanation.

The hydraulic pump device 2 includes a hydraulic pump 2*a* and a regulator 2*b*. The regulator 2*b* is driven by the controller 100 and adjusts the delivery flow rate of the hydraulic pump 2*a*. The delivery port of the hydraulic pump 2*a* is connected to the control valve 20 via a supply hydraulic line 21.

The bleed-off section 20*a*, the boom section 20*b* and the arm section 20*c* of the control valve 20 are supplied with the hydraulic fluid from the hydraulic pump 2*a* via the supply hydraulic line 21. In the bleed-off section 20*a*, a branch hydraulic line 22 branches off from the supply hydraulic line 21, and the branch hydraulic line 22 is connected to a tank 29 via a bleed-off valve 25. The bleed-off valve 25 is driven by the controller 100, and bleeds off the hydraulic fluid from the hydraulic pump 2*a* by establishing communication between the supply hydraulic line 21 and the tank 29.

In the boom section 20*b*, the supply hydraulic line 21 is connected to an actuator hydraulic line 54*a* (54*b*) via a boom meter-in valve 53*a* (53*b*). The actuator hydraulic line 54*a* (54*b*) is connected to a bottom-side oil chamber 5*a* (rod-side oil chamber 5*b*) of the boom cylinder 5. In addition, the actuator hydraulic line 54*a* (54*b*) is connected to the tank 29 via a boom meter-out valve 55*a* (55*b*). The controller 100 can supply the hydraulic fluid from the hydraulic pump 2*a* to the bottom-side oil chamber 5*a* (rod-side oil chamber 5*b*) of the boom cylinder 5 by driving and opening the boom meter-in valve 53*a* (53*b*). In addition, the controller 100 can discharge the hydraulic fluid in the bottom-side oil chamber 5*a* (rod-side oil chamber 5*b*) of the boom cylinder 5 to the tank 29 by driving and opening the boom meter-out valve 55*a* (55*b*). Note that since the arm section 20*c* has the same configuration as the boom section 20*b*, an explanation thereof is omitted.

The controller 100 receives inputs of: a boom operation signal and an arm operation signal from the right operation lever device 1*c* and the left operation lever device 1*d*; a supply pressure signal from a supply-pressure sensor 28 installed on the supply hydraulic line 21; a boom pressure signal from a boom pressure sensor 58*a* installed on the actuator hydraulic line 54*a*; an arm pressure signal from an arm pressure sensor 68*a* installed on an actuator hydraulic line 64*a*; a boom meter-in valve position signal from a boom meter-in valve position sensor 59*a* installed on the boom meter-in valve 53*a*; and an arm meter-in valve position signal from an arm meter-in valve position sensor 69*a* installed on an arm meter-in valve 63*a*. On the basis of these inputs, the controller 100 drives the regulator 2*b*, the bleed-off valve 25, the boom meter-in valves 53*a* and 53*b*, the boom meter-out valves 55*a* and 55*b*, arm meter-in valves 63*a* and 63*b*, and arm meter-out valves 65*a* and 65*b*.

Although the pressure sensors 58*a* and 68*a* are provided only on the actuator hydraulic lines 54*a* and 64*a* in the configuration in the present embodiment for simplification of explanation here, pressure sensors may be provided also on the actuator hydraulic lines 54*b* and 64*b*. In addition, valve position sensors may be provided on all of the bleed-off valve 25, the boom meter-in valves 53*a* and 53*b*, the boom meter-out valves 55*a* and 55*b*, the arm meter-in valves 63*a* and 63*b* and the arm meter-out valves 65*a* and 65*b*.

Figure 3:
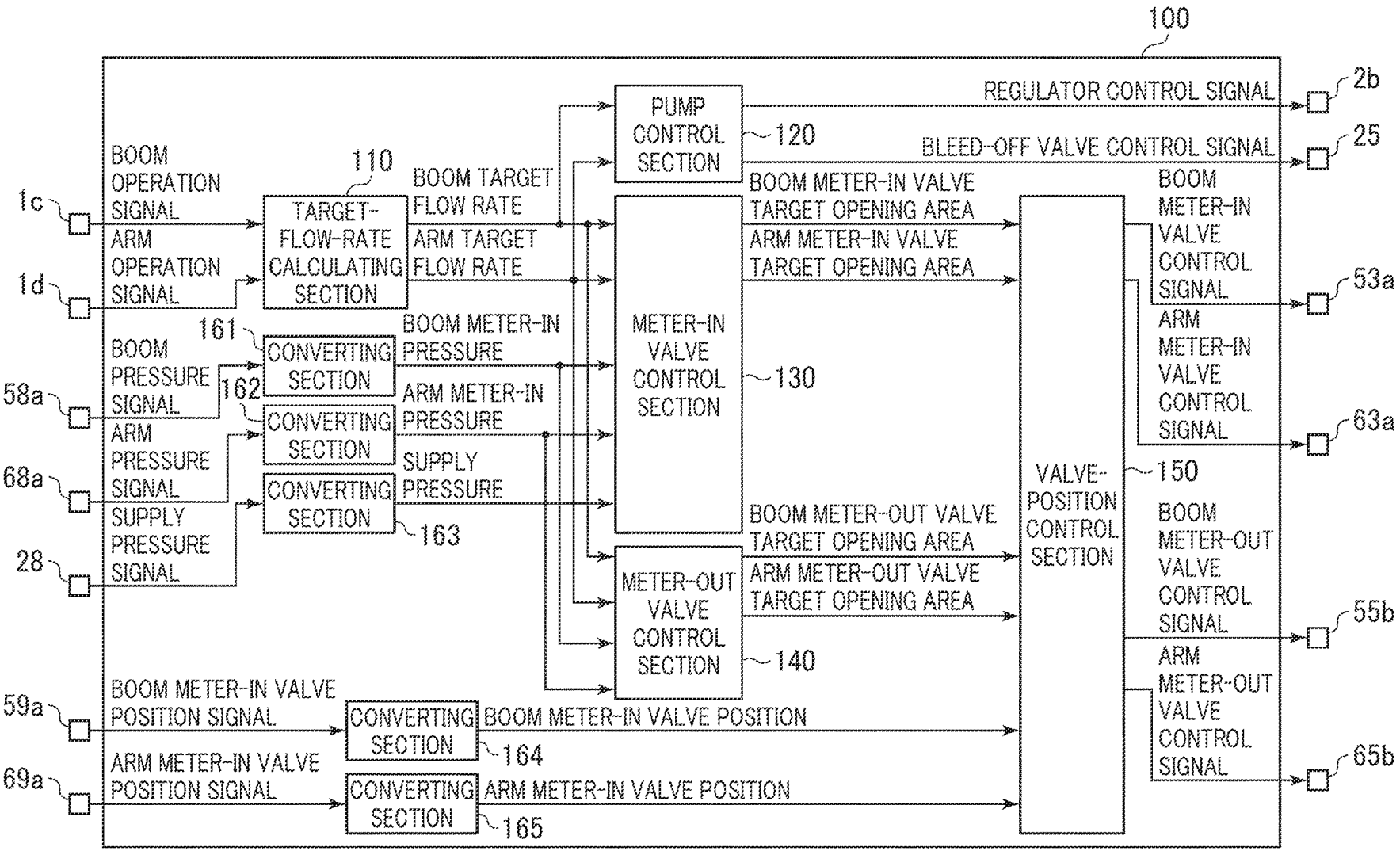
FIG. 3 is a functional block diagram of a controller illustrated in FIG. 2.

FIG. 3 is a functional block diagram of the controller 100. Note that only portions related to the function of supplying the hydraulic fluid from the hydraulic pump 2*a* to the bottom-side oil chambers 5*a* and 6*a* of the boom cylinder 5 and the arm cylinder 6 are illustrated, and portions related to other functions are omitted in FIG. 3 for simplification of explanation.

In FIG. 3, the controller 100 has a target-flow-rate calculating section 110, a pump control section 120, a meter-in valve control section 130, a meter-out valve control section 140, a valve-position control section 150 and converting sections 161 to 165.

The converting sections 161 to 165 convert signals from sensors into physical values, and output the physical values. For example, from a boom pressure signal, an arm pressure signal and a supply pressure signal which are voltage values, and by using a pressure conversion map, the converting sections 161, 162 and 163 calculate and output a boom meter-in pressure, an arm meter-in pressure and a supply pressure which are pressure values. From a boom meter-in valve position signal and an arm meter-in valve position signal which are duty ratios, and by using a stroke conversion map, the converting sections 164 and 165 calculate and output a boom meter-in valve position and an arm meter-in valve position which are stroke values.

On the basis of the boom operation signal and the arm operation signal from the right operation lever device 1*c* and the left operation lever device 1*d*, the target-flow-rate calculating section 110 calculates a boom target flow rate and an arm target flow rate, and transmits the boom target flow rate and the arm target flow rate to the pump control section 120, the meter-in valve control section 130 and the meter-out valve control section 140. For example, as the backward inclination of the right operation lever device 1*c* relative to the machine body increases, the boom target flow rate is increased toward the positive side; as the forward inclination of the right operation lever device 1*c* relative to the machine body increases, the boom target flow rate is increased toward the negative side; as the rightward inclination of the left operation lever device 1*d* relative to the machine body increases, the arm target flow rate is increased toward the positive side; and as the leftward inclination of the left operation lever device 1*d* relative to the machine body increases, the arm target flow rate is increased toward the negative side.

On the basis of the boom target flow rate and the arm target flow rate, the pump control section 120 calculates a regulator control signal and a bleed-off valve control signal, and outputs the regulator control signal and the bleed-off valve control signal to the regulator 2*b* and the bleed-off valve 25, respectively. For example, the regulator control signal is calculated such that the hydraulic fluid is supplied from the hydraulic pump 2*a* in an amount equal to the total value of the absolute value of the boom target flow rate and the absolute value of the arm target flow rate, and the bleed-off valve control signal is calculated such that the bleed-off valve 25 is closed according to the regulator control signal.

On the basis of the boom target flow rate, the arm target flow rate, the boom meter-in pressure, the arm meter-in pressure and the supply pressure, the meter-in valve control section 130 calculates a boom meter-in valve target opening area and an arm meter-in valve target opening area, and outputs the boom meter-in valve target opening area and the arm meter-in valve target opening area to the valve-position control section 150. These calculations are the same as calculation methods described in Patent Document 1, for example.

On the basis of the boom target flow rate, the arm target flow rate, the boom meter-in pressure, the arm meter-in pressure and the supply pressure, the meter-out valve control section 140 calculates a boom meter-out valve target opening area and an arm meter-out valve target opening area, and outputs the boom meter-out valve target opening area and the arm meter-out valve target opening area to the valve-position control section 150. Details of the calculations performed at the meter-out valve control section 140 are mentioned below.

On the basis of the boom meter-in valve target opening area, the arm meter-in valve target opening area, the boom meter-out valve target opening area, the arm meter-out valve target opening area, the boom meter-in valve position and the arm meter-in valve position, the valve-position control section 150 calculates a boom meter-in valve control signal, an arm meter-in valve control signal, a boom meter-out valve control signal and an arm meter-out valve control signal, and outputs the boom meter-in valve control signal, the arm meter-in valve control signal, the boom meter-out valve control signal and the arm meter-out valve control signal to the boom meter-in valve 53*a*, the arm meter-in valve 63*a*, the boom meter-out valve 55*b* and the arm meter-out valve 65*b*, respectively. For example, the control signals are calculated by using a map indicating the opening area characteristics of the valves such that the valves are at valve positions according to the target opening areas. In addition, the control signals may be corrected by known feedback control according to deviations between the valve positions according to the target opening areas and valve positions acquired at the valve position sensors 59*a* and 69*a*.

Figure 4:
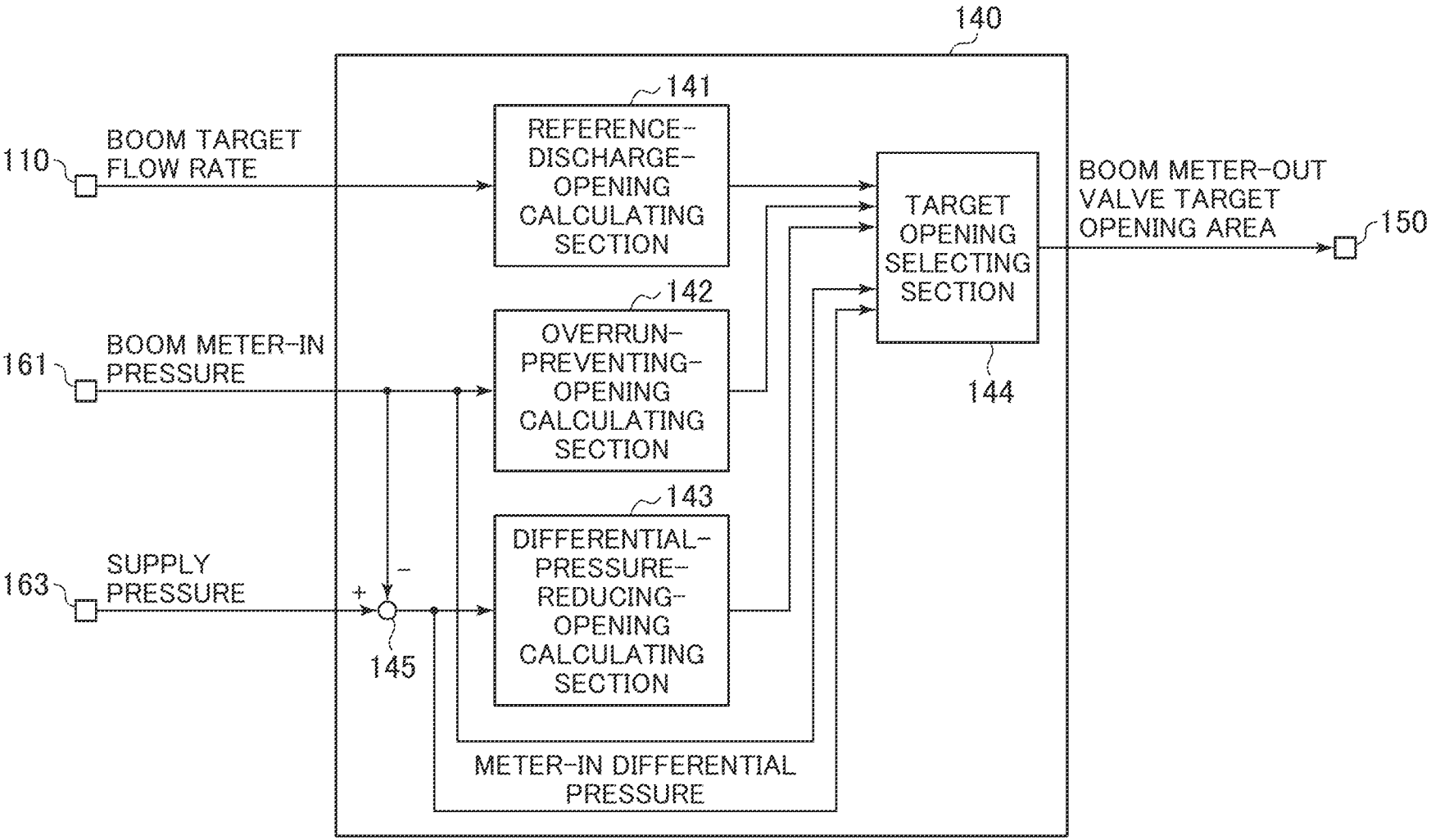
FIG. 4 is a functional block of a meter-out valve control section illustrated in FIG. 3.

FIG. 4 is a functional block diagram of the meter-out valve control section 140. Note that only portions related to the calculation of the boom meter-out valve target opening area are illustrated, and portions related to a calculation of the arm meter-out valve target opening area are omitted in FIG. 4. Note that the calculation of the arm meter-out valve target opening area is performed similarly to the calculation of the boom meter-out valve target opening area explained below.

In FIG. 4, the meter-out valve control section 140 has a reference-discharge-opening calculating section 141, an overrun-preventing-opening calculating section 142, a differential-pressure-reducing-opening calculating section 143, a target opening selecting section 144 and a subtracting section 145.

The subtracting section 145 subtracts the boom meter-in pressure from the supply pressure to calculate the differential pressure across the meter-in valve 53*a* (53*b*), and outputs the differential pressure to the differential-pressure-reducing-opening calculating section 143.

On the basis of the boom target flow rate, the reference-discharge-opening calculating section 141 calculates a reference discharge opening area, and outputs the reference discharge opening area to the target opening selecting section 144. For example, the reference discharge opening area is calculated such that it increases as the boom target flow rate increases. For the purpose of suppressing the pressure loss that occurs due to the rate of a meter-out flow discharged from the boom, the reference discharge opening area is desirably calculated such that the opening area of the boom meter-out valve increases according to the boom target flow rate.

On the basis of the boom meter-in pressure, the overrun-preventing-opening calculating section 142 calculates an overrun-preventing opening area, and outputs the overrun-preventing opening area to the target opening selecting section 144. For example, the overrun-preventing opening area is calculated such that it decreases as the value obtained by subtracting the boom meter-in pressure from a predetermined value (e.g. 5 MPa) increases. Typically, in a case where an overrun of a hydraulic actuator occurs (the hydraulic actuator is driven by free fall or by an external force, for example), the meter-in pressure becomes approximately zero. Accordingly, in the present embodiment, for the purpose of preventing an overrun of the boom 11, the overrun-preventing opening area is desirably calculated according to the boom meter-in pressure such that the boom meter-in pressure is maintained at a value sufficiently larger than zero.

Figure 5:
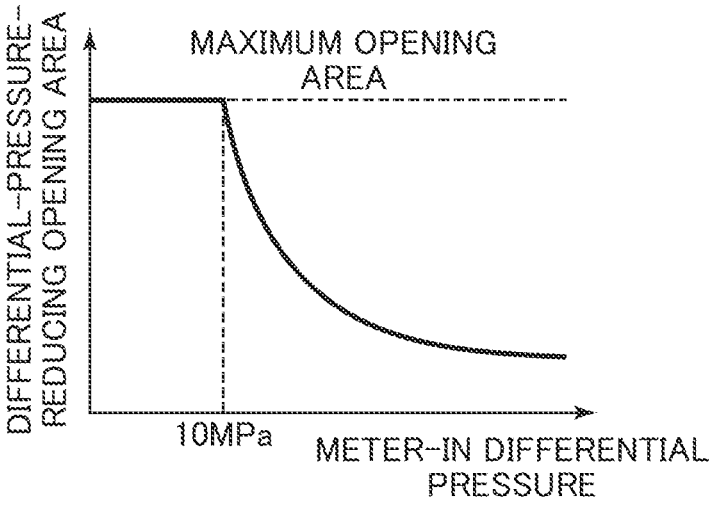
FIG. 5 is a figure illustrating one example of a differential-pressure-reducing-opening map used in a calculation by a differential-pressure-reducing-opening calculating section.
Figure 13:
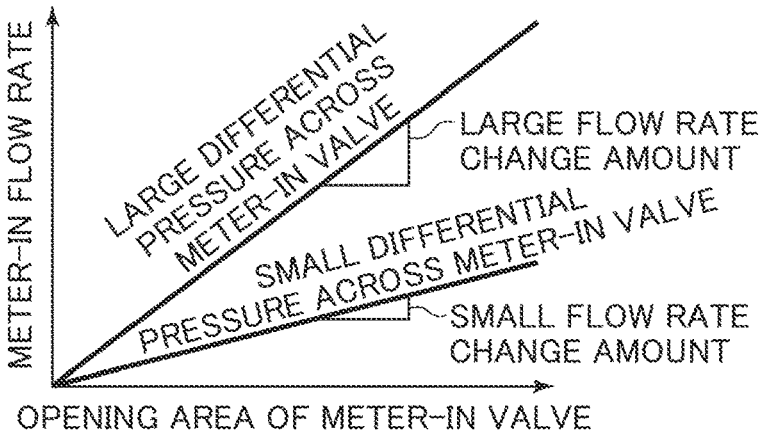
FIG. 13 is a figure illustrating a relationship between differential pressures across a meter-in valve and meter-in flow rates.

On the basis of the meter-in differential pressure, the differential-pressure-reducing-opening calculating section 143 calculates a differential-pressure-reducing opening area, and outputs the differential-pressure-reducing opening area to the target opening selecting section 144. For example, the differential-pressure-reducing-opening map illustrated in FIG. 5 is used to calculate the differential-pressure-reducing opening area. As illustrated in FIG. 5, the meter-out opening area of the boom is reduced and the meter-out pressure is increased as the meter-in differential pressure increases (e.g.

if the meter-in differential pressure is equal to or higher than 10 MPa). Since the meter-out pressure acts as a brake of the boom 11, if the meter-out pressure is increased, the apparent load on the boom 11 increases, and the meter-in differential pressure decreases. By reducing the meter-in differential pressure, the opening area of the boom meter-in valve 53*a* (53*b*) for attaining the boom target flow rate increases, and a hydrodynamic force that acts on the valve body can be reduced. In addition, as illustrated in FIG. 13, a change amount of the meter-in flow rate in relation to a change amount of the meter-in opening area can be reduced. Thereby, meter-in flow-rate errors caused by a hydrodynamic force that acts on the valve body of the meter-in valve 53*a* (53*b*), and by errors of the valve position sensor 59*a* can be reduced.

The target opening selecting section 144 selects one of the reference discharge opening area, the overrun-preventing opening area and the differential-pressure-reducing opening area, and outputs the selected one as a boom meter-out target opening area to the valve-position control section 150.

Figure 6:
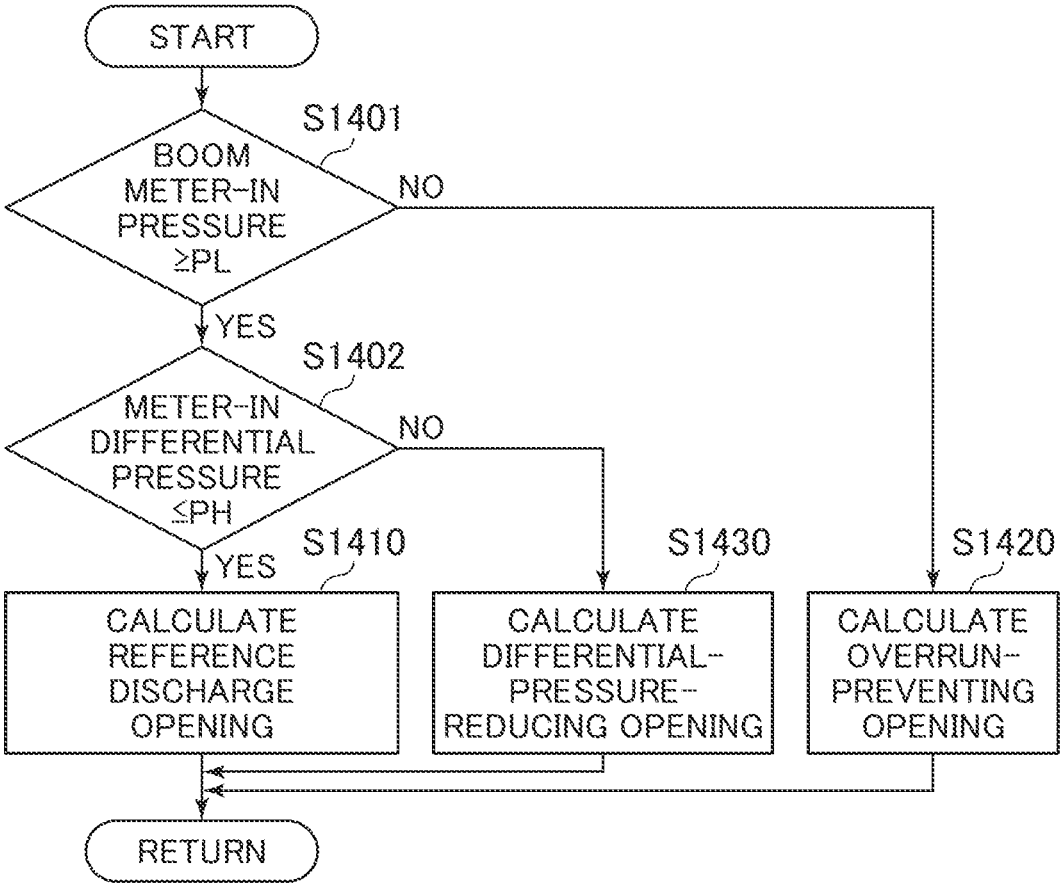
FIG. 6 is a flowchart illustrating a calculation process of a target opening selecting section illustrated in FIG. 4.

FIG. 6 is a flowchart illustrating a calculation process of the target opening selecting section 144.

If the meter-in pressure is equal to or higher than a threshold PL (e.g. 5 MPa) at Step S1401, the process proceeds to Step S1402, and otherwise the process proceeds to Step S1420.

At Step S1420, an overrun-preventing opening area is selected as the boom meter-out target opening area, and output to the valve-position control section 150.

If the meter-in differential pressure is equal to or lower than a threshold PH (e.g. 10 MPa) at Step S1402, the process proceeds to Step S1410, and otherwise the process proceeds to Step S1430. Here, in a case where only the boom cylinder 5 is driven, the boom meter-in valve 53*a* (53*b*) is fully opened, and the rate of a flow supplied to the boom cylinder 5 is adjusted by the delivery flow rate of the hydraulic pump 2*a*. Accordingly, the load pressure on the boom cylinder 5 and the delivery pressure of the hydraulic pump 2*a* become almost equal, and the differential pressure across the boom meter-in valve 53*a* (53*b*) does not become equal to or higher than the threshold PH. The differential pressure across the boom meter-in valve 53*a* (53*b*) becomes equal to or higher than the threshold PH when the delivery pressure of the hydraulic pump 2*a* becomes higher than the boom meter-in pressure along with an increase of the arm meter-in pressure that occurs when the boom cylinder 5 and the arm cylinder 6 are simultaneously driven.

At Step S1430, a differential-pressure-reducing opening area is selected as the boom meter-out target opening area, and output to the valve-position control section 150.

At Step S1410, a reference discharge opening area is selected as the boom meter-out target opening area, and output to the valve-position control section 150.

As mentioned above, in a case where the boom meter-in pressure is low, since the overrun-preventing opening area is selected as the boom meter-out target opening area, an overrun of the boom 11 can be prevented. In addition, even in a case where the boom meter-in pressure is high, the differential-pressure-reducing opening area is selected as the boom meter-out target opening area when the meter-in pressure difference is large. Accordingly, meter-in flow-rate errors caused by a hydrodynamic force that acts on the valve body of the boom meter-in valve 53*a* (53*b*), and by errors of the valve position sensor 59*a* can be reduced. In addition, in a case where the boom meter-in pressure is high, and the meter-in differential pressure is low, since the reference discharge opening area is selected as the boom meter-out target opening area, the pressure loss that occurs due to the meter-out flow rate can be suppressed.

The hydraulic excavator (construction machine) 600 according to the present embodiment includes: the tank 29; the hydraulic pump 2*a*; the boom cylinder (first hydraulic actuator) 5 and the arm cylinder (second hydraulic actuator) 6 each having two supply and discharge ports; the first meter-in valves 53*a* and 53*b* provided on the hydraulic lines 54*a* and 54*b* connecting the boom cylinder (first hydraulic actuator) 5 to the hydraulic pump 2*a*; the second meter-in valves 63*a* and 63*b* provided on the hydraulic lines 64*a* and 64*b* establishing communication between the arm cylinder (second hydraulic actuator) 6 and the hydraulic pump 2*a*; the boom meter-out valves (first meter-out valves) 55*a* and 55*b* provided on the hydraulic lines establishing communication between the boom cylinder (first hydraulic actuator) 5 and the tank 29; the arm meter-out valves (second meter-out valves) 65*a* and 65*b* provided on the hydraulic lines establishing communication between the arm cylinder (second hydraulic actuator) and the tank 29; the boom pressure sensor (first pressure sensor) 58*a* that senses the boom meter-in pressure (first meter-in pressure) that is the load pressure on the boom cylinder (first hydraulic actuator); the arm pressure sensor (second pressure sensor) 68*a* that senses the arm meter-in pressure (second meter-in pressure) that is the load pressure on the arm cylinder (second hydraulic actuator) 6; the supply-pressure sensor (third pressure sensor) 28 that senses the supply pressure that is the delivery pressure of the hydraulic pump 2*a*; and the controller 100 having the meter-in valve control section 130 that calculates the target opening area of the boom meter-in valve (first meter-in valve) 53*a* (53*b*) according to the pressure difference between the supply pressure and the boom meter-in pressure (first meter-in pressure), and calculates the target opening area of the arm meter-in valve (second meter-in valve) 63*a* (63*b*) according to the pressure difference between the supply pressure and the arm meter-in pressure (second meter-in pressure). The controller 100 has the meter-out valve control section 140 that calculates the target opening area of the arm meter-out valve (second meter-out valve) 63*a* (63*b*) according to the pressure difference between the supply pressure and the arm meter-in pressure (second meter-in pressure), or calculates the target opening area of the boom meter-out valve (first meter-out valve) 55*a* (55*b*) according to the pressure difference between the supply pressure and the boom meter-in pressure (first meter-in pressure).

In addition, the meter-out valve control section 140 in the present embodiment reduces the target opening area of the boom meter-out valve (first meter-out valve) 55*a* (55*b*) as the pressure difference between the supply pressure of the hydraulic pump 2*a* and the boom meter-in pressure (first meter-in pressure) increases, or reduces the target opening area of the arm meter-out valve (second meter-out valve) 65*a* (65*b*) as the pressure difference between the supply pressure and the arm meter-in pressure (second meter-in pressure) increases.

In addition, the hydraulic excavator (construction machine) 600 according to the present embodiment includes: the upper swing structure (machine body) 10; the boom 11 pivotably attached to the upper swing structure 10; the arm 12 pivotably attached to the boom 11; and the bucket 8 pivotably attached to a tip section of the arm 12, and includes: the boom cylinder (first hydraulic actuator) 5 that drives the boom 11; the arm cylinder (second hydraulic actuator) 6 that drives the arm 12; and the bucket cylinder (second hydraulic actuator) that drives the bucket 8.

According to the thus-configured present embodiment, by controlling the arm meter-out valve 65*a* (65*b*) according to the pressure difference between the supply pressure and the arm meter-in pressure or by controlling the boom meter-out valve 55*a* (55*b*) according to the pressure difference between the supply pressure and the boom meter-in pressure, the differential pressure across the boom meter-in valve 55*a* (55*b*) or the arm meter-in valve 63*a* (63*b*) that supplies the hydraulic fluid to one of the boom cylinder 5 and the arm cylinder 6 that is receiving a lower load lowers. Thereby, without being affected by load conditions of the boom cylinder 5 and the arm cylinder 6, the opening areas of the boom meter-in valve 55*a* (55*b*) and the arm meter-in valve 63*a* (63*b*) increase, and change amounts of the meter-in flow rates in relation to change amounts of the opening areas decrease. Accordingly, meter-in flow-rate errors caused by a hydrodynamic force that acts on the valve body of the boom meter-in valve 55*a* (55*b*) or the arm meter-in valve 63*a* (63*b*), and by errors of the opening area of the boom meter-in valve 53*a* (53*b*) or the arm meter-in valve 63*a* (63*b*) are reduced.

Note that although the controller 100 is mounted on the hydraulic excavator 600 in the configuration explained in the present embodiment, the controller 100 may be arranged separately from the hydraulic excavator 600, and the remote operation of the hydraulic excavator 600 may be enabled, for example.

Second Embodiment

A second embodiment of the present invention is explained with reference to FIG. 7 to FIG. 9.

The present embodiment reduces meter-in flow-rate errors caused by errors of the pressure sensors 28, 58*a* and 68*a* that sense meter-in differential pressures.

Figure 7:
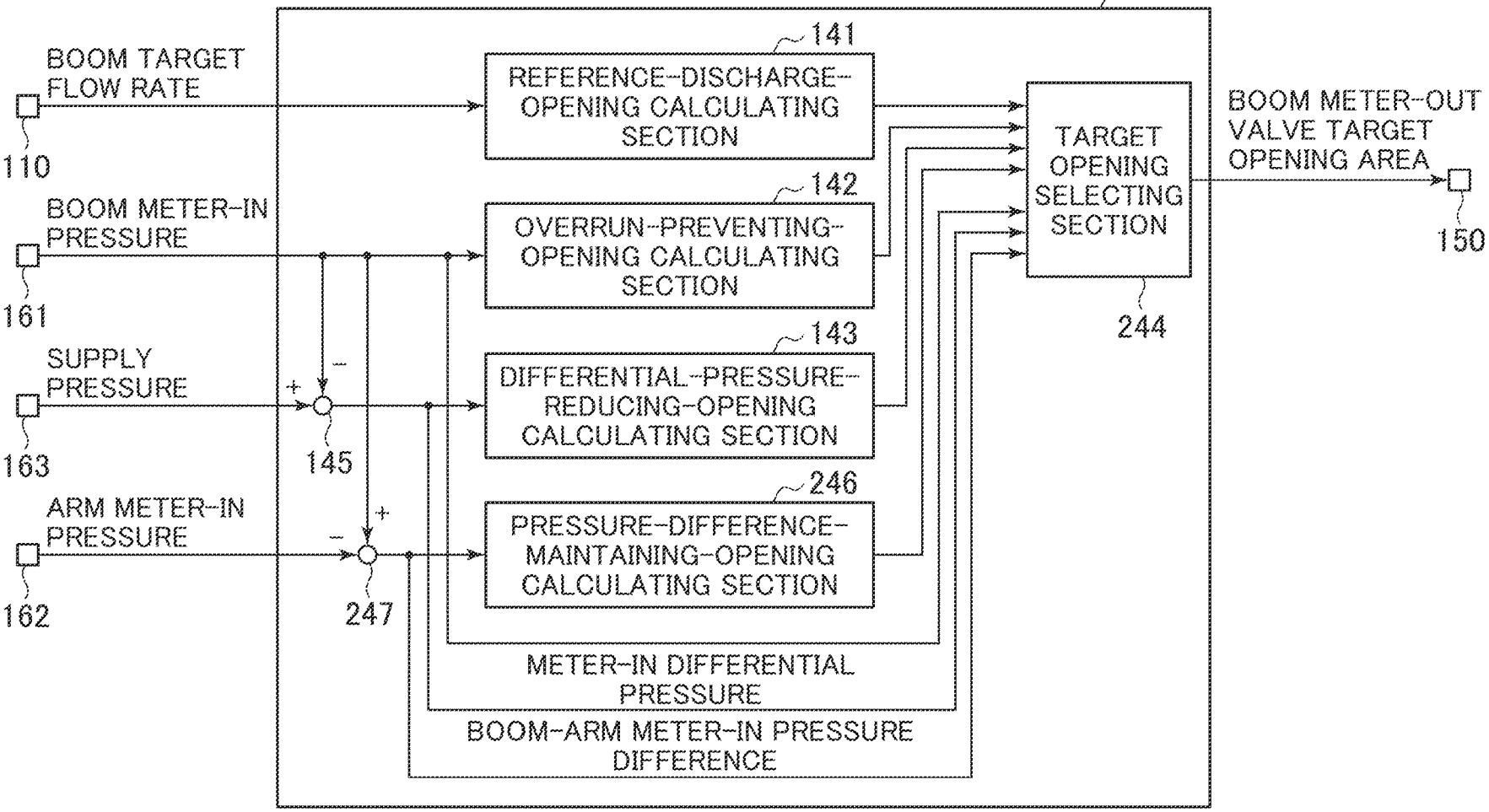
FIG. 7 is a functional block diagram of the meter-out valve control section in a second embodiment of the present invention.
Figure 8:
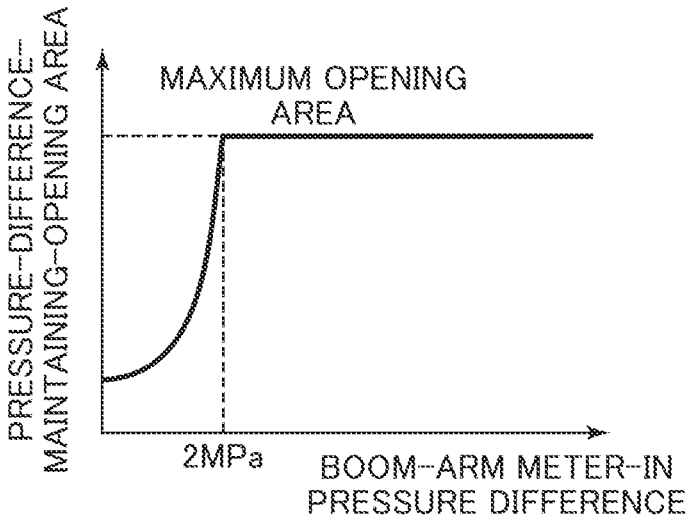
FIG. 8 is a figure illustrating one example of a pressure-difference-maintaining-opening map used in a calculation by a pressure-difference-maintaining-opening calculating section illustrated in FIG. 7.

FIG. 7 is a functional block diagram of the meter-out valve control section 140 in the present embodiment. Hereinafter, differences from the first embodiment (illustrated in FIG. 4) are explained mainly.

In FIG. 7, the meter-out valve control section 140 has the reference-discharge-opening calculating section 141, the overrun-preventing-opening calculating section 142, the differential-pressure-reducing-opening calculating section 143 and the subtracting section 145, and further has a target opening selecting section 244, a pressure-difference-maintaining-opening calculating section 246 and a subtracting section 247.

The subtracting section 247 calculates a pressure difference (hereinafter, a boom-arm meter-in pressure difference) obtained by subtracting the arm meter-in pressure from the boom meter-in pressure, and outputs the boom-arm meter-in pressure difference to the pressure-difference-maintaining-opening calculating section 246.

On the basis of the boom-arm meter-in pressure difference, the pressure-difference-maintaining-opening calculating section 246 calculates a pressure-difference-maintaining opening area, and outputs the pressure-difference-maintaining opening area to the target opening selecting section 244. For example, a pressure-difference-maintaining-opening map illustrated in FIG. 8 is used to calculate the pressure-difference-maintaining opening area. The opening area of the boom meter-out valve is reduced, and the meter-out pressure of the boom cylinder 5 is increased as the boom-arm meter-in pressure difference decreases (e.g. if the boom-arm meter-in pressure difference is equal to or smaller than 2 MPa). Typically, when the front work implement 15 is caused to swing in the air, the meter-in pressure of the boom cylinder 5 is higher than that of the arm cylinder 6, but when an excavation reaction force acts on the boom 11 at the time of excavation, the meter-in pressure of the boom cylinder 5 becomes lower than that of the arm cylinder 6. When the meter-out pressure of the boom cylinder 5 is higher than the meter-out pressure of the arm cylinder 6, for the purpose of suppressing the pressure loss, the meter-in valve 53*a* (53*b*) of the boom cylinder 5 is fully opened in a state in which the bleed-off valve 25 is closed, and the opening area of the meter-in valve 63*a* (63*b*) of the arm cylinder 6 is adjusted to thereby control the rate of a flow supplied to the boom cylinder 5. At this time, the meter-in pressure of the boom cylinder 5 is almost equal to the supply pressure of the hydraulic pump 2*a*, and the meter-in differential pressure of the boom cylinder 5 becomes almost zero. If an excavation reaction force acts on the boom 11 at the time of excavation, the meter-in pressure of the boom cylinder 5 lowers, and gets close to the meter-in pressure of the arm cylinder 6. In the first embodiment, at this time, since the meter-in differential pressure of the arm cylinder 6 decreases, errors of the pressure sensors 28, 58*a* and 68*a* become relatively too large to ignore, and it becomes difficult to precisely control the rate of a flow supplied to the boom cylinder 5 with the meter-in valve 63*a* (63*b*) closer to the arm cylinder 6. In the present embodiment, the pressure-difference-maintaining opening area is calculated on the basis of the pressure difference (boom-arm meter-in pressure difference) between the boom meter-in pressure and the arm meter-in pressure. Thereby, the meter-in pressure of the boom cylinder 5 is maintained at a pressure higher than that of the arm cylinder 6 even at the time of excavation, and it is made possible to reduce meter-in flow-rate errors caused by errors of the pressure sensors 28, 58*a* and 68*a* that sense the meter-in differential pressures.

The target opening selecting section 244 selects one of the reference discharge opening area, the overrun-preventing opening area, the differential-pressure-reducing opening area and the pressure-difference-maintaining opening area, and outputs the selected one as a boom meter-out target opening area to the valve-position control section 150.

Figure 9:
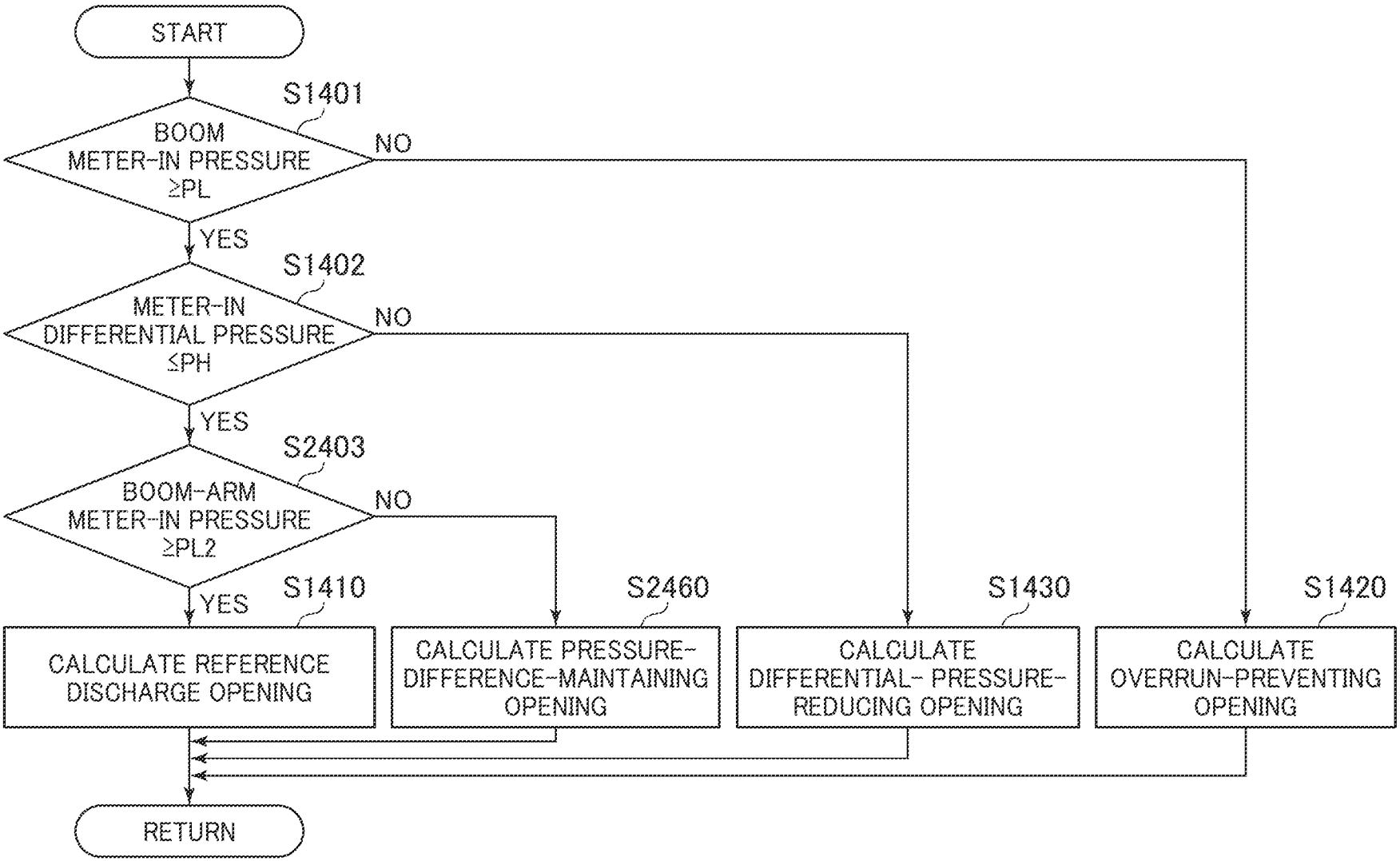
FIG. 9 is a flowchart illustrating a calculation process of a target opening selecting section illustrated in FIG. 7.

FIG. 9 is a flowchart illustrating a calculation process of the target opening selecting section 244. Hereinafter, differences from the first embodiment (illustrated in FIG. 6) are explained.

If the meter-in differential pressure is equal to or lower than the threshold PH (e.g. 10 MPa) at Step S1402, and the boom-arm meter-in pressure difference is equal to or larger than a threshold PL2 (e.g. 2 MPa) at Step S2403, the process proceeds to Step S1410, and otherwise the process proceeds to Step S2460.

At Step S2460, a pressure-difference-maintaining opening area is selected as the boom meter-out target opening area, and output to the valve-position control section 150.

In a case where the boom meter-in pressure (first meter-in pressure) is higher than the arm meter-in pressure (second meter-in pressure), and the pressure difference between the boom meter-in pressure (first meter-in pressure) and the arm meter-in pressure (second meter-in pressure) is smaller than the threshold (first predetermined pressure difference), the meter-out valve control section 140 in the present embodiment reduces the target opening area of the boom meter-out valve (first meter-out valve) 55*a* (55*b*), or in a case where the arm meter-in pressure (second meter-in pressure) is higher than the boom meter-in pressure (first meter-in pressure), and the pressure difference between the arm meter-in pressure (second meter-in pressure) and the boom meter-in pressure (first meter-in pressure) is smaller than the threshold (second predetermined pressure difference), the meter-out valve control section 140 in the present embodiment reduces the target opening area of the second meter-out valve.

According to the thus-configured present embodiment, the following effects are attained in addition to effects similar to those attained with the first embodiment.

In a case where the boom meter-in pressure is higher than the arm meter-in pressure, and the pressure difference therebetween is small, the pressure-difference-maintaining opening area is selected as the target opening area of the boom meter-out valve 55*a* (55*b*). Accordingly, the meter-in pressure of the boom cylinder 5 can be maintained at a pressure higher than that of the arm cylinder 6 even at the time of excavation, and meter-in flow-rate errors caused by errors of the pressure sensors 28, 58*a* and 68*a* that sense the meter-in differential pressures can be reduced.

Third Embodiment

A third embodiment of the present invention is explained with reference to FIG. 10 to FIG. 12.

In the present embodiment, a differential-pressure-reducing opening area is calculated without sensing a meter-in differential pressure.

Figure 10:
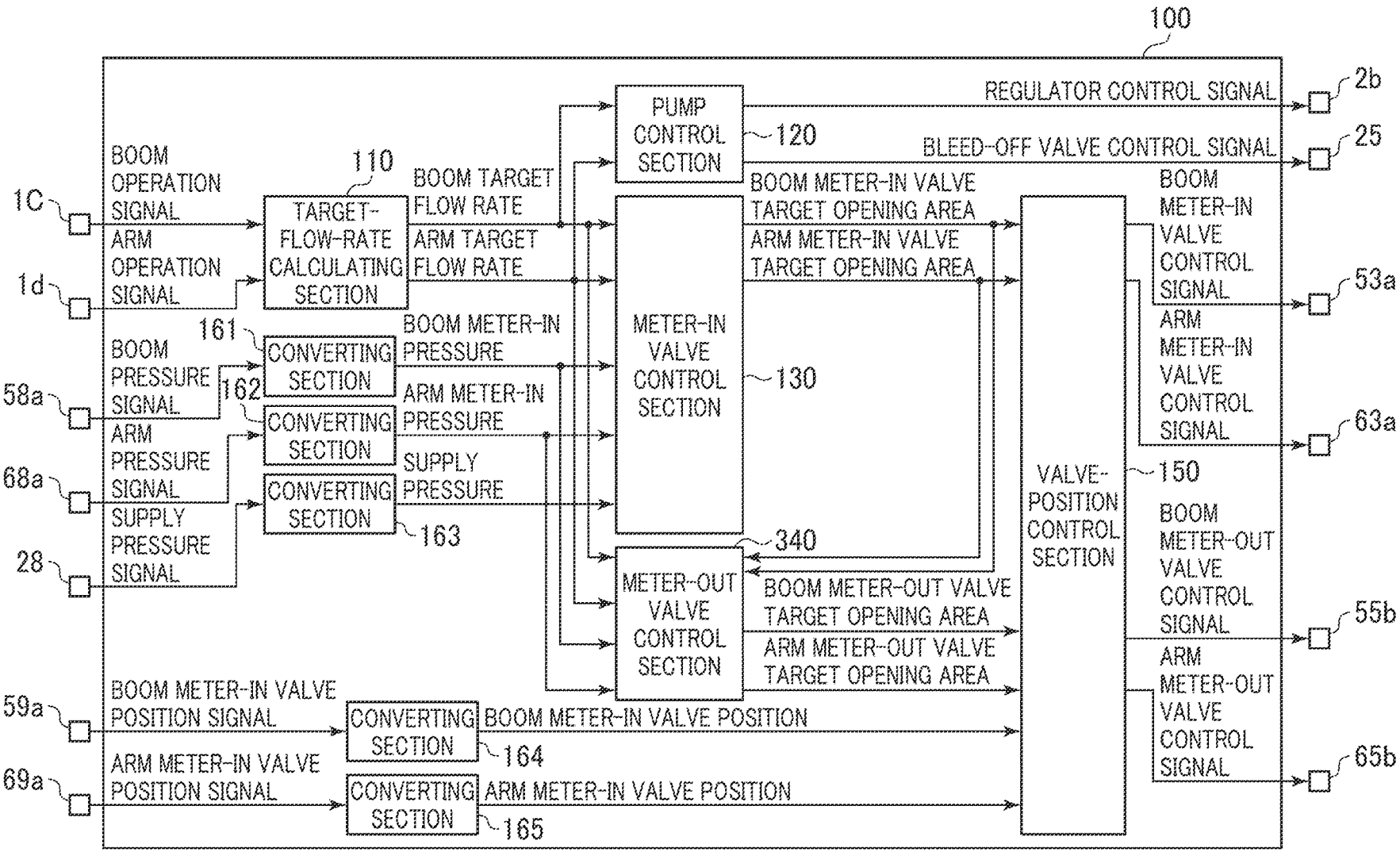
FIG. 10 is a functional block diagram of the controller in a third embodiment of the present invention.

FIG. 10 is a functional block diagram of the controller 100 in the present embodiment. Hereinafter, differences from the first embodiment (illustrated in FIG. 3) are explained mainly.

In FIG. 10, the controller 100 has the target-flow-rate calculating section 110, the pump control section 120, the meter-in valve control section 130, a meter-out valve control section 340, the valve-position control section 150 and the converting sections 161 to 165. The meter-out valve control section 340 in the present embodiment is different from the meter-out valve control section 140 (illustrated in FIG. 3) in the first embodiment in that it does not receive an input of a supply pressure from the converting section 163, but receives inputs of the boom meter-in valve target opening area and the arm meter-in valve target opening area from the meter-in valve control section 130.

Figure 11:
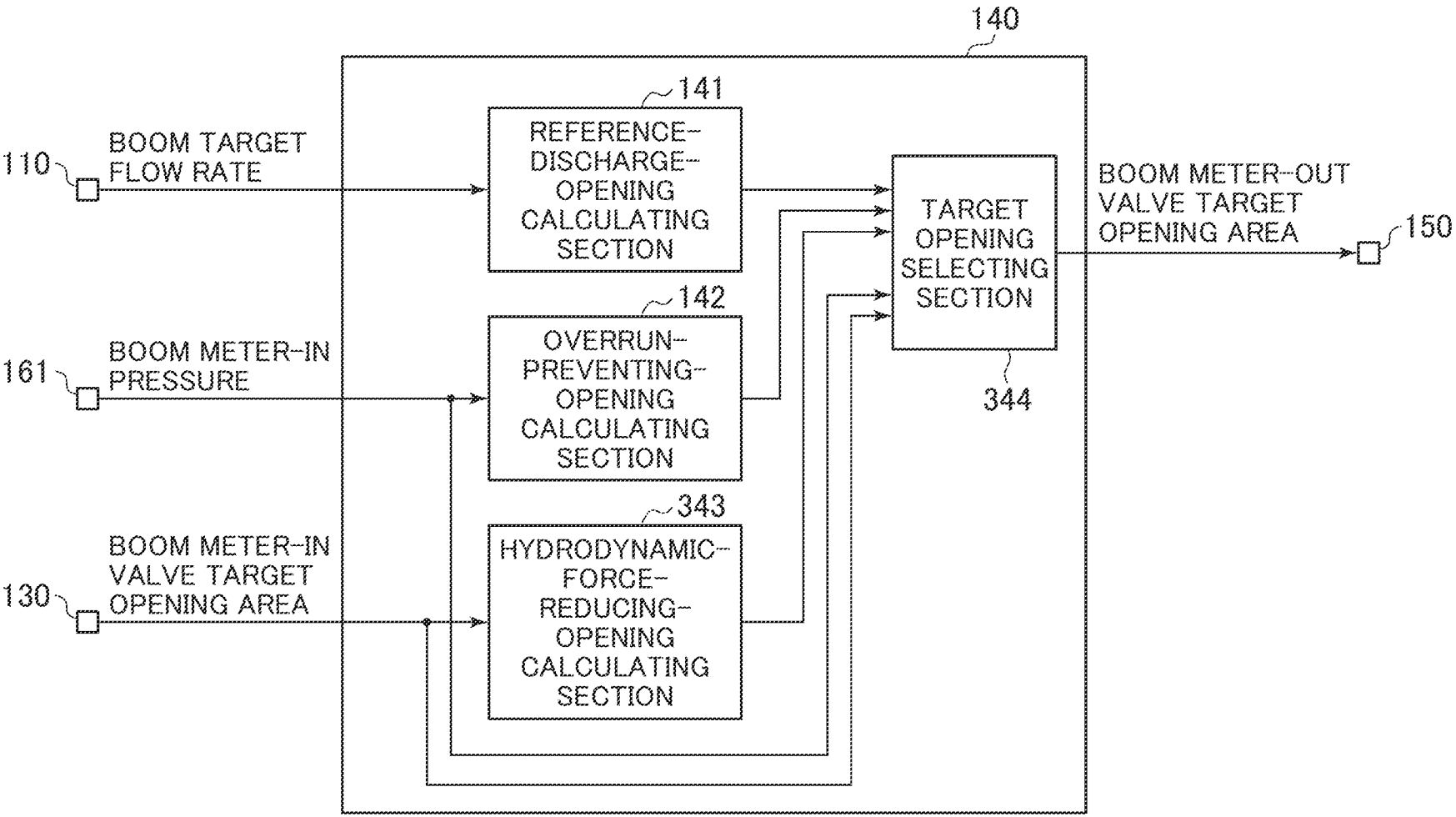
FIG. 11 is a functional block diagram of a meter-out valve control section illustrated in FIG. 10.

FIG. 11 is a functional block diagram of the meter-out valve control section 340. Hereinafter, differences from the first embodiment (illustrated in FIG. 4) are explained mainly.

In FIG. 11, the meter-out valve control section 140 has the reference-discharge-opening calculating section 141, the overrun-preventing-opening calculating section 142 and a hydrodynamic-force-reducing-opening calculating section 343.

On the basis of the boom meter-in target opening area, the hydrodynamic-force-reducing-opening calculating section 343 calculates a hydrodynamic-force-reducing opening area, and outputs the hydrodynamic-force-reducing opening area to the target opening selecting section 144. The hydrodynamic-force-reducing-opening calculating section 343 gradually reduces the hydrodynamic-force-reducing opening area until the boom meter-in target opening area becomes equal to or larger than a predetermined value (e.g. 5 $mm^2$), for example. By reducing the meter-out opening area of the boom to increase the meter-out pressure, the boom meter-in target opening area can be increased to suppress a hydrodynamic force similarly to the first embodiment. In addition, as illustrated in FIG. 13, a change amount of the meter-in flow rate in relation to a change amount of the opening area can be reduced. Thereby, meter-in flow-rate errors caused by a hydrodynamic force that acts on the valve body of the meter-in valve 53*a* (53*b*), and by errors of the valve position sensor 59*a* can be reduced.

Figure 12:
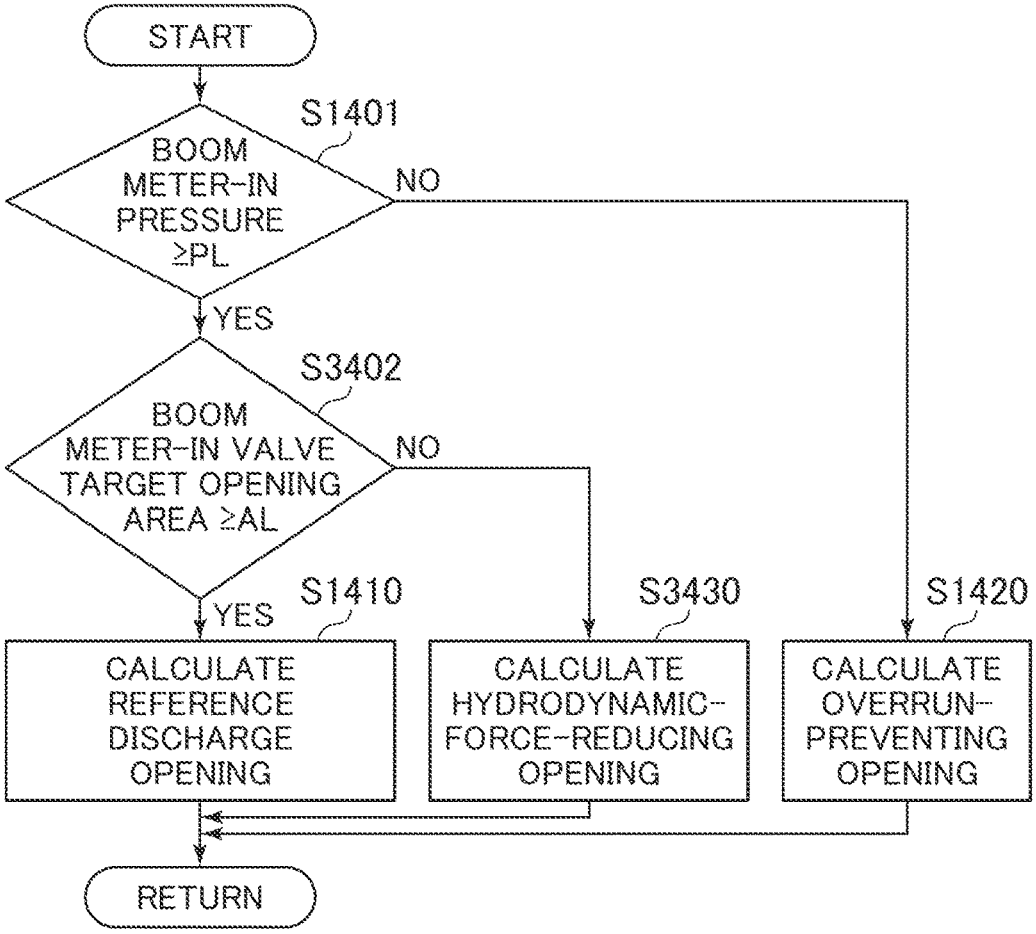
FIG. 12 is a flowchart illustrating a calculation process of a target opening selecting section illustrated in FIG. 11.

FIG. 12 is a flowchart illustrating a calculation process of a target opening selecting section 344. Hereinafter, differences from the first embodiment (illustrated in FIG. 6) are explained.

If the boom meter-in valve target opening area is equal to or larger than a threshold AL (e.g. 5 $mm^2$) at Step S3402, the process proceeds to Step S1410, and otherwise the process proceeds to Step S3430.

At Step S3430, a hydrodynamic-force-reducing opening area is selected as the boom meter-out target opening area, and output to the valve-position control section 150.

In a case where the target opening area of the boom meter-in valve (first meter-in valve) 53*a* (53*b*) is smaller than the threshold (first predetermined opening area) AL, the meter-out valve control section 140 in the present embodiment reduces the target opening area of the boom meter-out valve (first meter-out valve) 55*a* (55*b*), or in a case where the target opening area of the arm meter-in valve (second meter-in valve) 63*a* (63*b*) is smaller than the threshold (second predetermined opening area), the meter-out valve control section 140 in the present embodiment reduces the target opening area of the arm meter-out valve (second meter-out valve) 65*a* (65*b*).

According to the thus-configured present embodiment, in a case where the boom meter-in valve target opening area is small (the arm meter-in pressure is higher than the boom meter-in pressure, and the pressure difference therebetween is large), the hydrodynamic-force-reducing opening area is selected as the boom meter-out target opening area, or in a case where the arm meter-in valve target opening area is small (the boom meter-in pressure is higher than the arm meter-in pressure, and the pressure difference therebetween is large), the hydrodynamic-force-reducing opening area is selected as the arm meter-out target opening area. Accordingly, similarly to the first embodiment, meter-in flow-rate errors caused by hydrodynamic forces that act on the valve bodies of the meter-in valves 53*a*, 53*b*, 63*a* and 63*b*, and by errors of the opening areas of the meter-in valves 53*a*, 53*b*, 63*a* and 63*b* can be reduced.

Note that although the differential-pressure-reducing opening area is calculated by using the meter-in target opening area in the example explained in the present embodiment, the differential-pressure-reducing opening area may be calculated on the basis of signals of the valve position sensors 59*a* and 69*a*.

Although embodiments of the present invention are mentioned in detail thus far, the present invention is not limited to the embodiments described above, and includes various modification examples. For example, although the present invention is applied to a hydraulic excavator including a bucket as a work instrument at the tip of a front device in the embodiments described above, application subjects of the present invention are not limited to this, and the present invention can be applied to hydraulic excavators including work instruments other than a bucket and construction machines other than hydraulic excavators. In addition, the embodiments described above are explained in detail in order to explain the present invention in an easy-to-understand manner, and the present invention is not necessarily limited to embodiments including all the configurations explained.

DESCRIPTION OF REFERENCE CHARACTERS

1*a*: Travel right operation lever device
1*b*: Travel left operation lever device

1*c*: Right operation lever device
1*d*: Left operation lever device
2: Hydraulic pump device
2*a*: Hydraulic pump
2*b*: Regulator
3*b*: Travel hydraulic motor
3*b*: Hydraulic actuator
4: Swing hydraulic motor (hydraulic actuator)
5: Boom cylinder (hydraulic actuator)
5*a*: Bottom-side oil chamber
5*b*: Rod-side oil chamber
6: Arm cylinder (hydraulic actuator)
7: Bucket cylinder (hydraulic actuator)
8: Bucket (work instrument)
8*a*: Bucket link
9: Lower track structure
10: Upper swing structure (machine body)
11: Boom
12: Arm
14: Engine (prime mover)
15: Front device
16: Cab
20: Control valve
20*a*: Bleed-off section
20*b*: Boom section
20*c*: Arm section
21: Supply hydraulic line
22: Branch hydraulic line
25: Bleed-off valve
28: Supply-pressure sensor
29: Tank
53*a*, 53*b*: Boom meter-in valve (first meter-in valve)
54*a*, 54*b*: Actuator hydraulic line
55*a*, 55*b*: Boom meter-out valve (first meter-out valve)
58*a*: Boom pressure sensor (first pressure sensor)
59*a*: Boom meter-in valve position sensor
63*a*, 63*b*: Arm meter-in valve (second meter-in valve)
64*a*, 64*b*: Actuator hydraulic line
65*a*, 65*b*: Arm meter-out valve (second meter-out valve)
68*a*: Arm pressure sensor (second pressure sensor)
69*a*: Arm meter-in valve position sensor
100: Controller
110: Target-flow-rate calculating section
120: Pump control section
130: Meter-in valve control section
140: Meter-out valve control section
141: Reference-discharge-opening calculating section
142: Overrun-preventing-opening calculating section
143: Differential-pressure-reducing-opening calculating section
144: Target opening selecting section
145: Subtracting section
150: Valve-position control section
161 to 165: Converting section
244: Target opening selecting section
246: Pressure-difference-maintaining-opening calculating section
247: Subtracting section
343: Hydrodynamic-force-reducing-opening calculating section
344: Target opening selecting section
600: Hydraulic excavator (construction machine)

The invention claimed is:

1. A construction machine comprising:

a tank;

a hydraulic pump;

a first hydraulic actuator and a second hydraulic actuator each having two supply and discharge ports;

a first meter-in valve provided on a hydraulic line connecting the first hydraulic actuator to the hydraulic pump;

a second meter-in valve provided on a hydraulic line that establishes communication between the second hydraulic actuator and the hydraulic pump;

a first meter-out valve provided on a hydraulic line that establishes communication between the first hydraulic actuator and the tank;

a second meter-out valve provided on a hydraulic line that establishes communication between the second hydraulic actuator and the tank;

a first pressure sensor that senses a first meter-in pressure that is a load pressure on the first hydraulic actuator;

a second pressure sensor that senses a second meter-in pressure that is a load pressure on the second hydraulic actuator;

a third pressure sensor that senses a supply pressure that is a delivery pressure of the hydraulic pump; and a controller having a meter-in valve control section configured to calculate a target opening area of the first meter-in valve according to a pressure difference between the supply pressure and the first meter-in pressure, and calculate a target opening area of the second meter-in valve according to a pressure difference between the supply pressure and the second meter-in pressure, wherein the controller has a meter-out valve control section configured to calculate a target opening area of the second meter-out valve according to the pressure difference between the supply pressure and the second meter-in pressure, or calculate a target opening area of the first meter-out valve according to the pressure difference between the supply pressure and the first meter-in pressure.

2. The construction machine according to claim 1, wherein the meter-out valve control section is configured to reduce the target opening area of the first meter-out valve as the pressure difference between the supply pressure and the first meter-in pressure increases, or reduce the target opening area of the second meter-out valve as the pressure difference between the supply pressure and the second meter-in pressure increases.

3. The construction machine according to claim 1, wherein the meter-out valve control section is configured to, in a case where the first meter-in pressure is higher than the second meter-in pressure, and a pressure difference between the first meter-in pressure and the second meter-in pressure is smaller than a first predetermined pressure difference, reduce the target opening area of the first meter-out valve, or in a case where the second meter-in pressure is higher than the first meter-in pressure, and the pressure difference between the second meter-in pressure and the first meter-in pressure is smaller than a second predetermined pressure difference, reduce the target opening area of the second meter-out valve.

4. The construction machine according to claim 1, comprising:

a machine body;

a boom pivotably attached to the machine body;

an arm pivotably attached to the boom; and a bucket pivotably attached to a tip section of the arm, wherein the first hydraulic actuator is a boom cylinder that drives the boom, and the second hydraulic actuator is an arm cylinder that drives the arm or a bucket cylinder that drives the bucket.

5. The construction machine according to claim 1, wherein the meter-out valve control section is configured to, in a case where the target opening area of the first meter-in valve is smaller than a first predetermined opening area, reduce the target opening area of the first meter-out valve, or in a case where the target opening area of the second meter-in valve is smaller than a second predetermined opening area, reduce the target opening area of the second meter-out valve.

* * * * *